US011697482B1

(12) United States Patent
Vance, Jr.

(10) Patent No.: US 11,697,482 B1
(45) Date of Patent: Jul. 11, 2023

(54) JACK PLATE

(71) Applicant: David Edward Vance, Jr., Fayetteville, TN (US)

(72) Inventor: David Edward Vance, Jr., Fayetteville, TN (US)

( * ) Notice: Subject to any disclaimer, the term of this patent is extended or adjusted under 35 U.S.C. 154(b) by 0 days.

(21) Appl. No.: 17/210,460

(22) Filed: Mar. 23, 2021

Related U.S. Application Data

(60) Provisional application No. 62/993,677, filed on Mar. 23, 2020.

(51) Int. Cl.
*B63H 20/10* (2006.01)

(52) U.S. Cl.
CPC ..... *B63H 20/106* (2013.01)

(58) Field of Classification Search
CPC ..... B63H 20/106
See application file for complete search history.

(56) References Cited

U.S. PATENT DOCUMENTS 5,944,568 A * 8/1999 Rabal ..... B63H 20/106 440/58
6,305,996 B1 * 10/2001 Detwiler ..... B63H 20/106 248/641

* cited by examiner

*Primary Examiner* — Stephen P Avila

(57) ABSTRACT

A jack plate has an assembly having a motor plate configured to support an outboard motor, and having a hull mount configured to mount to a boat hull such that the jack plate assembly has an adjusting bolt that when rotated raises the motor plate in relation to the position of the assembly on the hull.

11 Claims, 3 Drawing Sheets

Vance Industries, LLC
JJP21519 Assembly
Assembly w/ No Dimension
1/27/2020
D
1/2
SHEET 1 OF 1
2.000
7.000
50

Figures 1, 2, 3, 4:
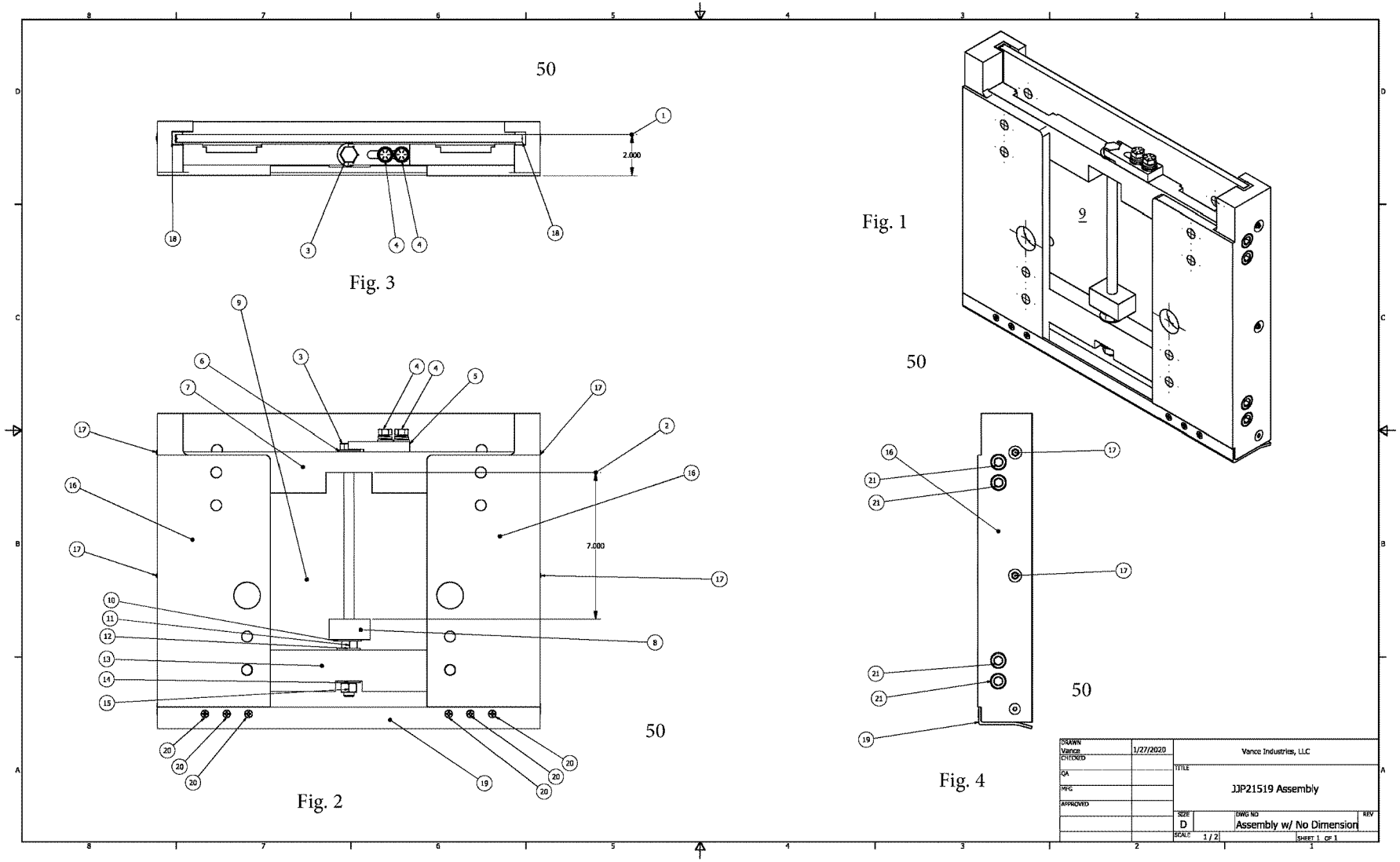

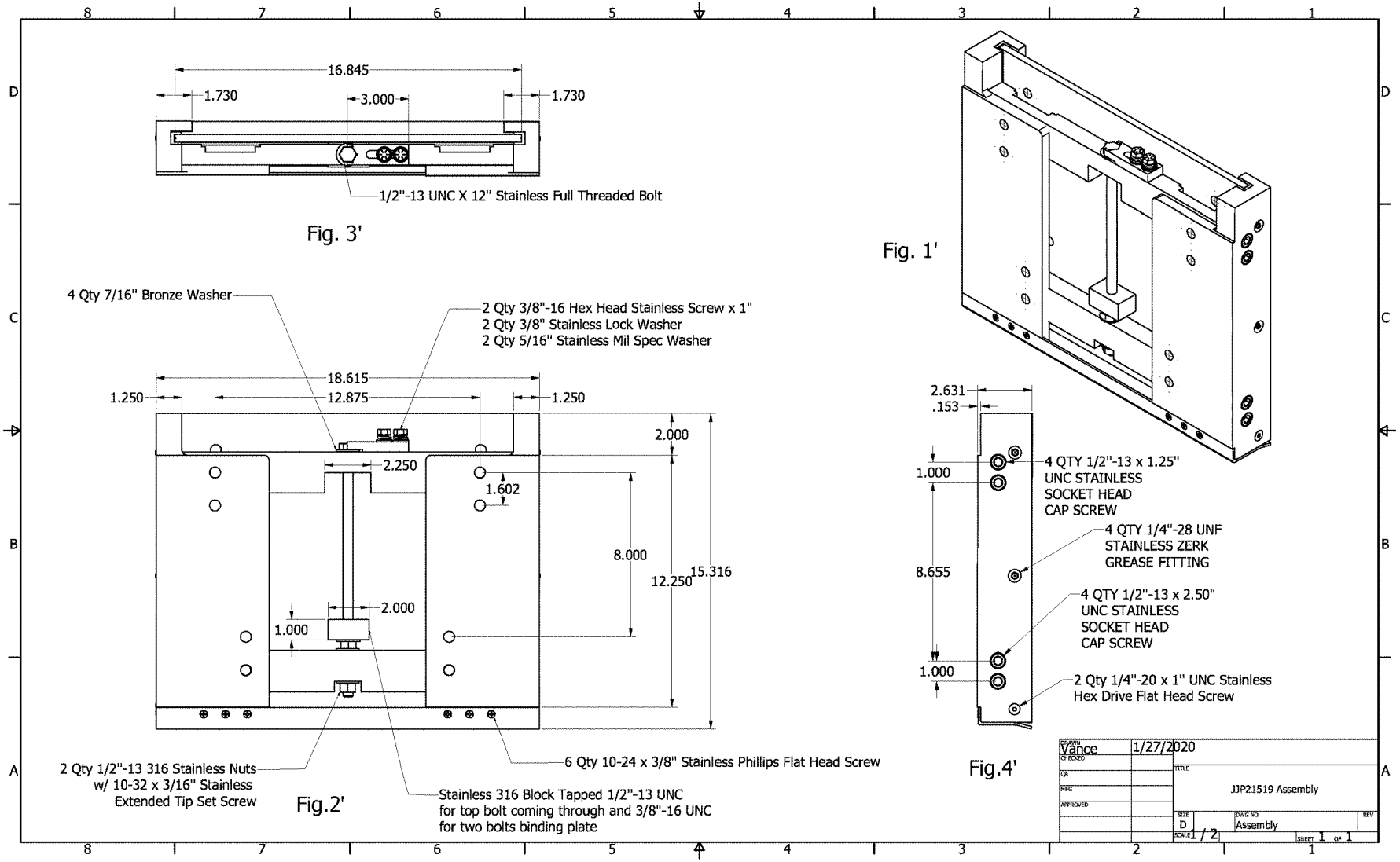
Fig. 1'
4 QTY 1/2"-13 x 1.25" UNC STAINLESS SOCKET HEAD CAP SCREW
4 QTY 1/4"-28 UNF STAINLESS ZERK GREASE FITTING
4 QTY 1/2"-13 x 2.50" UNC STAINLESS SOCKET HEAD CAP SCREW
2 Qty 1/4"-20 x 1" UNC Stainless Hex Drive Flat Head Screw
2.631
.153
1.000
8.655
1.000
Fig.4'
DRAWN Vance
1/27/2020
TITLE
JJP21519 Assembly
DWG NO Assembly
SIZE D
SCALE 1/2
SHEET 1 OF 1
REV
1/2"-13 UNC X 12" Stainless Full Threaded Bolt
1.730
3.000
1.730
16.845
Fig. 3'
2 Qty 3/8"-16 Hex Head Stainless Screw x 1"
2 Qty 3/8" Stainless Lock Washer
2 Qty 5/16" Stainless Mil Spec Washer
15.316
12.250
2.000
8.000
1.250
1.602
2.250
2.000
1.000
18.615
12.875
1.250
4 Qty 7/16" Bronze Washer
6 Qty 10-24 x 3/8" Stainless Phillips Flat Head Screw
Stainless 316 Block Tapped 1/2"-13 UNC for top bolt coming through and 3/8"-16 UNC for two bolts binding plate
2 Qty 1/2"-13 316 Stainless Nuts w/ 10-32 x 3/16" Stainless Extended Tip Set Screw
Fig.2'

JACK PLATE

CROSS-REFERENCE TO RELATED APPLICATIONS

Not Applicable

STATEMENT REGARDING FEDERALLY SPONSORED RESEARCH

Not Applicable

FIELD OF THE INVENTION

This invention relates generally to outboard engine mounting jack plates.

BACKGROUND OF THE INVENTION

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art or as teaching against other aspects that are, in fact, contemplated to be a portion of this invention.

Outboard motors (i.e., outboard motors, outboard engines, or outboards) are typically in a fixed position with respect to the transom of a boat. The outboard motor can be bolted through holes in the transom or clamped onto the transom via a clamp integral with the outboard motor. Jack plates are sometimes also used wherein the jack plate is mounted to the boat transom and then the motor is mounted to the jack plate. The jack plate can be used to raise or lower the engine within the water. It is advantageous to be able to adjust the height of the engine on the jack plate while on the water as there are shallow places or objects that can damage an engine, prop, and hull. The instant invention allows for the engine to be raised vertically while on the water.

The art referred to and/or described within this application is not intended to constitute an admission that any patent, publication or other information referred to herein is "prior art" with respect to this invention. In addition, this section should not be construed to mean that a thorough search has been made or that no other pertinent information as defined in 37 C.F.R. § 1.56(a) exists.

All US patents and applications and all other published documents mentioned anywhere in this application are incorporated herein by reference in their entirety. Specifically, U.S. Pat. No. 10,343,756 filed on May 21, 2018 and U.S. Provisional Application 62/509,451 filed on May 22, 2017 are incorporated by reference in their entirety and are part of the intellectual property of the instant inventor, Edward Vance.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well, only for the purposes of complying with 37 C.F.R. 1.72. The abstract is not intended to be used for interpreting the scope of the claims.

BRIEF SUMMARY OF THE INVENTION

In some embodiments a jack plate assembly can have a motor plate configured to support an outboard motor and have a hull mount configured to mount to a boat hull. The jack plate assembly can have an adjusting bolt that when rotated raises the motor plate in relation to the position of the assembly on the hull.

In some embodiments the adjusting bolt passes through a hole within the cross member which is in a fixed position relative to the hull mount and through a hole within a block affixed to and in fixed position with the motor plate such that movement of the block up the adjusting bolt raises the motor plate relative to the hull mount and boat hull.

In some embodiments the hull mount includes a back portion and side portions wherein each side portion has a slot therein such that the motor plate can slide up and down within the slot.

In some embodiments the slot minimizes lateral movement of the motor plate such that the motor plate movement is limited to substantially vertical movement within the slot.

In some embodiments, the adjusting bolt is threaded and matches the threading of the hole within the cross member and the hole within the block.

In some embodiments the assembly can include a locking mechanism with an engagement end and a slot end wherein the locking mechanism has a locked position and an unlocked position. In the locked position the engagement end engages the adjusting bolt and restricts the rotation of the adjusting bolt and the slot end is secured into place. In the unlocked position the slot end is unloosened and the locking mechanism is slid away from the adjusting bolt such that the engagement end is free of the adjusting bolt.

In some embodiments, the adjusting bolt can have a bolt head and the engagement end of the locking mechanism can match the shape of the bolt head such that when the locking mechanism is in a locked position the engagement end engages the bolt head and restrains rotation of the adjusting bolt.

In some embodiments, the adjusting bolt has a handle portion wherein when rotated in a first direction raises the motor plate in relation to the position of the assembly on the hull and when rotated in a second direction lowers the motor plate in relation to the position of the assembly on the hull.

In some embodiments, the jack plate assembly has a motor plate configured to support an outboard motor, and having a hull mount configured to mount to a boat hull; the jack plate assembly having an adjusting bolt that when rotated in a first direction raises the motor plate in relation to the position of the assembly on the hull and when rotated in a second direction lowers the motor plate in relation to the position of the assembly on the hull; the adjusting bolt passing through a hole within the cross member which is in a fixed position relative to the hull mount and passing through a hole within a block affixed to and in fixed position with the motor plate such that movement of the block up the adjusting bolt raises the motor plate relative to the hull mount and boat hull; the hull mount including a back portion and side portions, each side portion having a slot therein such that the motor plate can slide up and down within the slot and wherein the slot minimizes lateral movement of the motor plate such that the motor plate movement is limited to substantially vertical movement within the slot.

In some embodiments, the jack plate assembly has a motor plate configured to support an outboard motor, and having a hull mount configured to mount to a boat hull; the jack plate assembly having an adjusting bolt that when rotated in a first direction raises the motor plate in relation to the position of the assembly on the hull and when rotated in a second direction lowers the motor plate in relation to the position of the assembly on the hull; wherein the adjusting bolt is threaded and matches the threading of the hole within the cross member and the hole within the block; the assembly further having a locking mechanism with an engagement end and a slot end, the locking mechanism having a locked position and an unlocked position, in the locked position the engagement end engages the adjusting bolt and restricts the rotation of the adjusting bolt and the slot end is secured into place, in the unlocked position the slot end is unloosened and the locking mechanism is slid away from the adjusting bolt such that the engagement end is free of the adjusting bolt; the adjusting bolt having a bolt head and the engagement end of the locking mechanism matches the shape of the bolt head such that when the locking mechanism is in a locked position the engagement end engages the bolt head and restrains rotation of the adjusting bolt.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

Figures 5, 6, 7, 8:
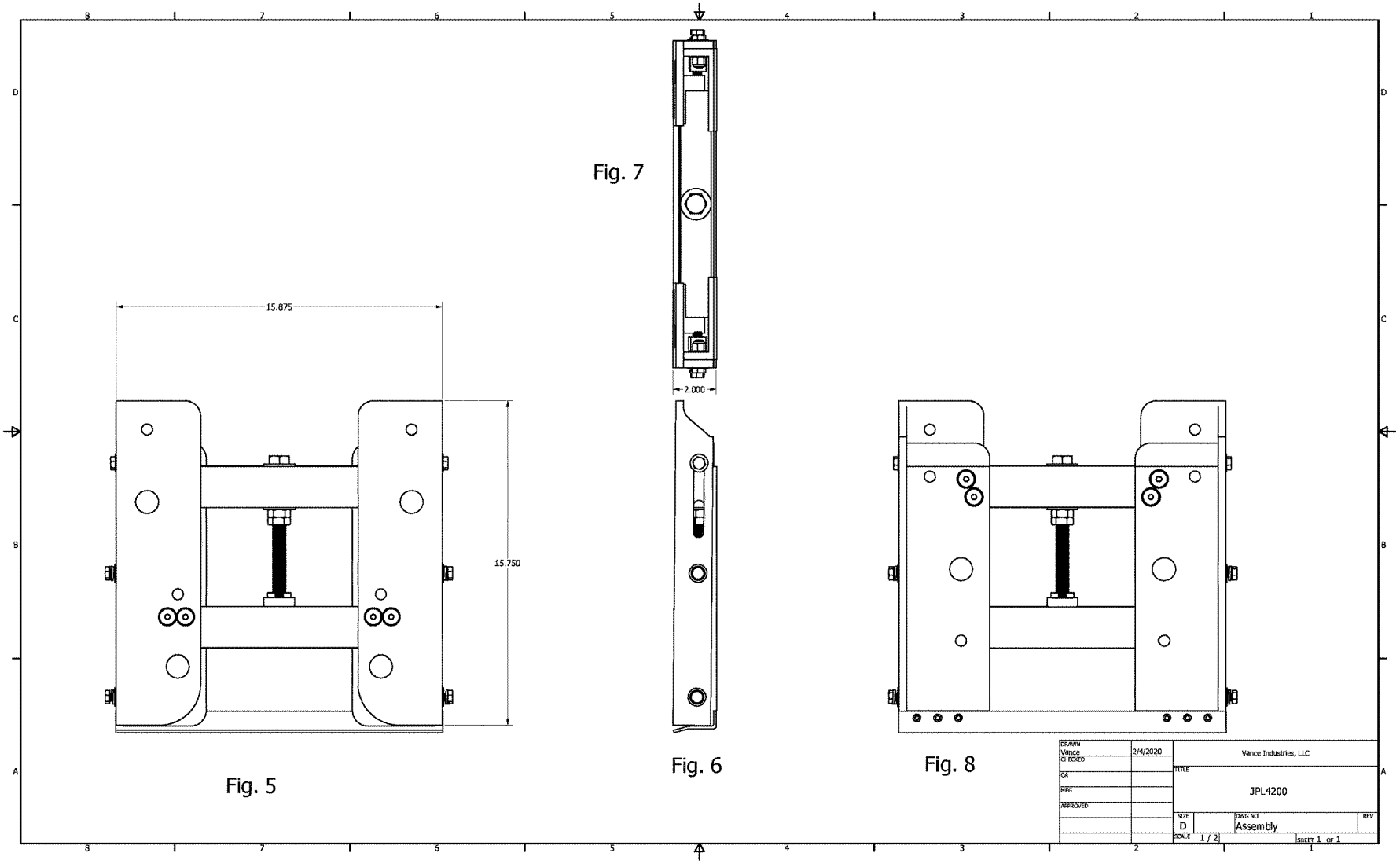

FIG. 1 is a perspective view of an inventive jack plate.
FIG. 2 is a front view of an inventive jack plate.
FIG. 3 is a top view of an inventive jack plate.
FIG. 4 is a side view of an inventive jack plate.
FIG. 1' is a perspective view of an inventive jack plate.
FIG. 2' is a front view of an inventive jack plate.
FIG. 3' is a top view of an inventive jack plate.
FIG. 4' is a side view of an inventive jack plate.
FIG. 5 is a front view of an inventive jack plate.
FIG. 6 is a side view of an inventive jack plate.
FIG. 7 is a top view of an inventive jack plate.
FIG. 8 is a back view of an inventive jack plate.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated. While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

A perspective view of an embodied jack plate 50 is shown in FIG. 1. Plate 9 as illustrated is the motor plate 9 and can be lowered and lifted with this invention. The jack plate 50 can set the engine back. In some embodiments it sets the engine back 2" as shown by thickness measurement 1 of FIG. 3. The inventive Jack plate is designed to create vertical lift. In some embodiments it has 7 inches of adjustable vertical lift as shown by measurement 2 of FIG. 2. In some embodiments the jack plate sets the engine back between 2 and 10 inches. In some embodiments more than 10 inches. In some embodiments between less than 2 inches and 1 inch and in some embodiments less than 1 inch. The vertical lift of the jack plate in some embodiments is less than 7 and in some embodiments as small as 4 inches. In some embodiments the vertical lift is between 0.5 and 4 inches. In some embodiments the vertical lift is greater than 7 and in some embodiments between 10 and 40 inches. And in some embodiments the vertical lift is greater than 40 inches.

As shown in FIGS. 1-4, the jack plate can be used to adjust the height of an engine even while on the water. In some embodiments the height adjustment is done using only one wrench to adjust the center adjusting bolt 3. In some embodiments, as shown, the center adjusting bolt 3 can be adjusted by loosening the slide lock bolts 4 on the top of the slide lock mechanism 5 and sliding the slide lock mechanism 5 out of the way of the adjusting bolt 3. The slide lock mechanism 5 can be a plate with a notch that fits the head shape and size of the center adjusting bolt 3. By sliding the slide lock mechanism 5 over after adjusting the top center bolt 3, the top center bolt 3 can be inhibited from turning as the notch in the slide lock mechanism 5 can engage the head of the bolt 3. Tightening the slide lock bolts 4 can also be done and further secure the bolt 3 from turning substantially. Other bolt adjusting items can be used such as a handle or an integral handle that can be turned without having to use a wrench on a bolt head. The handle can be locked in place to secure the bolt 3 from unwanted rotation. It should be noted that while a bolt 3 is illustrated, other rotatable mechanisms can also be used that would raise a block 8 attached to a motor plate 9.

The top center bolt 3 when rotated moves the jack plate up or down. Again, after adjusting the height of the jack plate to the desired height through rotation of the center adjusting bolt 3, the center adjusting bolt can be locked in place by sliding the locking mechanism 5 about the center adjusting bolt head 3 and tightening the lock bolts 4 thereby tightening the mechanism 5. The center adjusting bolt 3 can be designed to pass through a washer (or multiple washers) which can be made of multiple materials (e.g. plastic, metal, ceramic). In some embodiments one or more bronze washer(s) can be used. The bolt 3 can also pass through an upper cross member 7 and through a threaded block 8 (e.g. stainless steel). As illustrated in FIG. 2, the block 8 can be mounted onto a sliding plate 9 on to which an engine can be mounted. Thus, the vertical position of the engine can be adjusted up or down using the center adjusting bolt 3 such that as the block 8 moves up or down the plate 9 moves up or down relative to the upper cross member 7 and the side plates 16 affixed to the boat. The bolt 3 can extend further through a washer 10 (e.g. bronze), a nut (e.g. stainless) with a set screw 11. The set screw can be tightened onto a machined flat on the center adjusting bolt 3 so that the upper nut 11 cannot spin freely.

The bolt also passes through another washer 12 (e.g. bronze) and through a lower cross member 13 and through a washer 14 at the lower side of the lower cross member 13. The bolt 3 is fastened by a nut with a set screw 15. The set screw can be tightened onto a machined flat on the center adjusting bolt 3 so that the lower nut 15 (e.g. stainless) cannot spin freely. The center adjusting bolt 3 can have two flats that are machined precisely for the nuts that have set screws to screw and tighten onto so that they do not move or spin freely. When you adjust the vertical height through rotating the bolt 3 with a socket or wrench, the nuts with set screws do not move and allow the plate 9 attached to the block 8 (e.g. stainless) to move freely up or down within design constraints 2 as designed in FIG. 2; 7 inches in FIG. 2.

The side pieces 16 can have two automotive zerk grease fittings 17 on each side of the unit for easy lubrication and maintenance of the sliding plate 9. Inside the side pieces 16 can be one piece of high strength plastic 18 that is machined and bolted to the inside of each side pieces 16. The sliding plate 9 is then inserted into the high strength plastic sleeves 18 which allows the sliding plate 9 to slide freely and smoothly. The Performance plate 19 on the bottom can be affixed to the side pieces 16 with screws 20 which doesn't allow water to come up from below into the cavity of the unit and causing a spraying issue. The upper cross member 7 and lower cross member 13 can be affixed to the side pieces 16 using fasteners 21 joining all units together.

The FIGS. 1-4 can have multiple dimensions as the jack plate can be made larger or smaller.

In FIGS. 1'-4' an embodiment of the invention is given with given dimensions. Of course adjustments can be made in these sizes.

In some embodiments the jack plate is rated for engines having no more than 60 HP with the dimensions of FIGS. 1-4 and constructed of aluminum. But with thicker aluminum or stronger materials stronger engines can be used such as up to 115 HP and possibly higher. With material changes or with larger dimensions the jack plate can be used a much stronger engines.

FIGS. 5-8 illustrates a jack plate wherein the angles raise up when adjusting the center bolt 3 instead of the sliding plate 9. In some embodiments this jack plate also has a setback for the engine of around 2. In some embodiments this jack plate rises a maximum of 4 inches.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A jack plate assembly having a motor plate configured to support an outboard motor, and having a hull mount configured to mount to a boat hull; the jack plate assembly having an adjusting bolt that when rotated in a first direction raises the motor plate in relation to the position of the assembly on the hull and when rotated in a second direction lowers the motor plate in relation to the position of the assembly on the hull, the adjusting bolt passes through a hole within the cross member which is in a fixed position relative to the hull mount and through a hole within a block affixed to and in fixed position with the motor plate such that movement of the block up the adjusting bolt raises the motor plate relative to the hull mount and boat hull, the block disposed beneath the cross member.

2. The jack plate assembly of claim 1 wherein the hull mount includes a back portion and side portions, each side portion having a slot therein such that the motor plate can slide up and down within the slot.

3. The jack assembly of claim 2 wherein the slot minimizes lateral movement of the motor plate such that the motor plate movement is limited to substantially vertical movement within the slot.

4. The jack assembly of claim 1 wherein the adjusting bolt is threaded and matches the threading of the hole within the cross member and the hole within the block.

5. The jack plate assembly of claim 4 having a locking mechanism with an engagement end and a slot end, the locking mechanism having a locked position and an unlocked position, in the locked position the engagement end engages the adjusting bolt and restricts the rotation of the adjusting bolt and the slot end is secured into place, in the unlocked position the slot end is unloosened and the locking mechanism is slid away from the adjusting bolt such that the engagement end is free of the adjusting bolt.

6. The jack plate assembly of claim 5 wherein the adjusting bolt has a bolt head and the engagement end of the locking mechanism matches the shape of the bolt head such that when the locking mechanism is in a locked position the engagement end engages the bolt head and restrains rotation of the adjusting bolt.

7. The jack plate assembly of claim 5 wherein the adjusting bolt has a handle portion wherein when rotated in a first direction raises the motor plate in relation to the position of the assembly on the hull and when rotated in a second direction lowers the motor plate in relation to the position of the assembly on the hull.

8. A jack plate assembly having a motor plate configured to support an outboard motor, and having a hull mount configured to mount to a boat hull; the jack plate assembly having an adjusting bolt that when rotated in a first direction raises the motor plate in relation to the position of the assembly on the hull and when rotated in a second direction lowers the motor plate in relation to the position of the assembly on the hull; wherein the adjusting bolt is threaded and matches the threading of the hole within the cross member and the hole within the block;

the assembly further having a locking mechanism with an engagement end and a slot end, the locking mechanism having a locked position and an unlocked position, in the locked position the engagement end engages the adjusting bolt and restricts the rotation of the adjusting bolt and the slot end is secured into place, in the unlocked position the slot end is unloosened and the locking mechanism is slid away from the adjusting bolt such that the engagement end is free of the adjusting bolt; the adjusting bolt having a bolt head and the engagement end of the locking mechanism matches the shape of the bolt head such that when the locking mechanism is in a locked position the engagement end engages the bolt head and restrains rotation of the adjusting bolt.

9. A jack plate assembly having a motor plate configured to support an outboard motor, and having a hull mount configured to mount to a boat hull; the jack plate assembly having an adjusting bolt that when rotated in a first direction raises the motor plate in relation to the position of the assembly on the hull and when rotated in a second direction lowers the motor plate in relation to the position of the assembly on the hull, the jack plate assembly further having a locking mechanism with an engagement end and a slot end, the locking mechanism having a locked position and an unlocked position, in the locked position the engagement end engages the adjusting bolt and restricts the rotation of the adjusting bolt and the slot end is secured into place, in the unlocked position the slot end is unloosened and the locking mechanism is slid away from the adjusting bolt such that the engagement end is free of the adjusting bolt.

10. The jack plate assembly of claim 9 wherein the adjusting bolt has a bolt head and the engagement end of the locking mechanism matches the shape of the bolt head such that when the locking mechanism is in a locked position the engagement end engages the bolt head and restrains rotation of the adjusting bolt.

11. The jack plate assembly of claim 9 wherein the adjusting bolt has a handle portion wherein when rotated in a first direction raises the motor plate in relation to the position of the assembly on the hull and when rotated in a second direction lowers the motor plate in relation to the position of the assembly on the hull.

* * * * *